US005136451A

United States Patent [19]

Valdemarsson et al.

[11] Patent Number: 5,136,451

[45] Date of Patent: Aug. 4, 1992

[54] CURRENT LIMITER

[75] Inventors: Stefan Valdemarsson; Emile Schreurs, both of Västerås, Sweden

[73] Assignee: Asea Brown Boveri, Västerås, Sweden

[21] Appl. No.: 405,321

[22] Filed: Sep. 11, 1989

[30] Foreign Application Priority Data

Sep. 14, 1988 [SE] Sweden ..... 8803241

[51] Int. Cl.[5] ..... H01H 9/30; H01H 33/16; H01H 33/20

[52] U.S. Cl. ..... 361/2; 361/138; 200/144 AP; 200/149 A

[58] Field of Search ..... 261/8, 9, 10, 12, 13, 261/2, 138, 4; 200/144 AP, 149 A, 144 A

[56] References Cited

U.S. PATENT DOCUMENTS

| | | | |
|---|---|---|---|
| 2,208,399 | 7/1940 | Slepian | 361/4 |
| 2,660,647 | 11/1953 | Rawlins | 200/144 |
| 2,988,622 | 6/1961 | Petermichl et al. | 200/149 |
| 3,430,016 | 2/1969 | Hurtle | 200/144 A |
| 3,436,597 | 4/1969 | Hurtle | 361/12 |
| 3,448,231 | 6/1969 | Heft | 200/149 |
| 3,475,620 | 10/1969 | Murray | 361/8 |
| 3,562,584 | 2/1971 | Yoshimura | 317/11 |
| 3,621,169 | 11/1971 | Heft et al. | 200/149 A |
| 3,632,926 | 1/1972 | Heft | 200/149 A |
| 3,735,074 | 5/1973 | Frind et al. | 200/149 A |
| 4,485,283 | 11/1984 | Hurtle | 200/149 A |
| 4,714,974 | 12/1987 | Schreurs et al. | 361/12 |
| 4,847,455 | 7/1989 | Valdemarsson | 200/144 R |

FOREIGN PATENT DOCUMENTS

| | | | |
|---|---|---|---|
| 0860445 | 1/1971 | Canada | 200/144 AP |
| 1161617 | 1/1964 | Fed. Rep. of Germany | 200/149 A |
| 1253333 | 11/1967 | Fed. Rep. of Germany | 200/149 A |
| 1613849 | 9/1970 | Fed. Rep. of Germany | 361/8 |
| 2927879 | 1/1981 | Fed. Rep. of Germany | 361/2 |
| 2599548 | 12/1987 | France . | |
| 589351 | 4/1977 | Switzerland . | |
| 1143890 | 2/1969 | United Kingdom . | |

*Primary Examiner*—Steven L. Stephan
*Assistant Examiner*—Thomas M. Dougherty
*Attorney, Agent, or Firm*—Watson, Cole Grindle & Watson

[57] ABSTRACT

A fault current limiter in which a resistor is inserted by a running arc. The arc is allowed to burn in a commutating unit until the current zero-crossing. Upon the passage through zero the arc is extinguished and the current is commutated to a shunt resistor. The commutating unit comprises a gap-formed nozzle, in which the arc is burning. The nozzle is defined by two nozzle halves of a material which gives off gas under the influence of the arc. Close to the nozzle inlet is a pressure accumulating chamber, in which an overpressure is built up during the arcing time. After current zero-crossing, the hot arc residues are effectively vented by means of the overpressure in the pressure accumulating chamber. For cooling the gas in the chamber and for guiding the gas flow, the chamber is divided into small sub-volumes defined by metal plates.

6 Claims, 2 Drawing Sheets

CURRENT LIMITER

TECHNICAL FIELD

The present invention relates to a fault current limiter of the kind comprising a contact device with at least two cooperating contacts, at least one of which is movable between a closed and an open position, at least two runner rails associated with the contact device, said runner rails being so arranged that the arc which is produced upon contact opening when a short-circuit current flows in the circuit, under the influence of the magnetic field generated by the current, is moved away from the contact device with the foot points of the arc running along the rails, and a commutating unit for commutation of the arcing current to a parallel resistor, said commutating unit surrounding those ends of the rails which are situated furthest away from the contact device. The current limiter is primarily intended for current limitation of short-circuit currents in distribution networks for medium voltage 1–36 kV, but it can be used, in principle, also for voltages both above and below this range.

PRIOR ART

It is previously known to utilize the high migration velocity of an arc to rapidly connect resistive runner rails into a circuit if a short circuit should occur therein. U.S. Pat. No. 4,714,974 describes a design of this kind which enables the connection, during the first 2–3 milliseconds of the short circuit, of a resistance into the circuit, so that even the first current peak is limited. The magnitude of the resistance that can be connected in this way, and hence the current limitation that can be attained, is, however, in practice limited with regard to the dimensions and weight of the runner rails. For example, for a current limiter with the rated voltage 12 kV, the total resistance of the runner rails cannot, for the reasons stated above, substantially exceed 1Ω.

SUMMARY OF THE INVENTION

The object of the present invention is to obtain, in a current limiter of the kind described, a more powerful limitation of the short-circuit current than what is possible in practice with the known design mentioned above. This is achieved according to the invention by designing the commutating unit so that between said two runner rails, a gap for enclosing the arc is arranged, said gap being defined by means of walls of a gas-generating insulating material, said gap being formed as a nozzle, one of the runner rails extending along the nozzle inlet and the other extending along the nozzle outlet, a pressure accumulating chamber being arranged near the nozzle inlet.

According to the invention, the arc created at the contact device of the current limiter is led into a commutating unit where it is allowed to await the passage through zero of the current. Upon the passage through zero the arc is extinguished and the current is commutated to a resistor which is connected in parallel with the contact device. This resistor may be of conventional design and may have a considerably higher resistance value than the runner rails. The short-circuit current is therefore limited substantially and can be broken by the ordinary circuit breaker.

BRIEF DESCRIPTION OF THE DRAWING

The invention will be explained in greater detail by means of examples with reference to the accompanying drawing, wherein.

Figure 1:
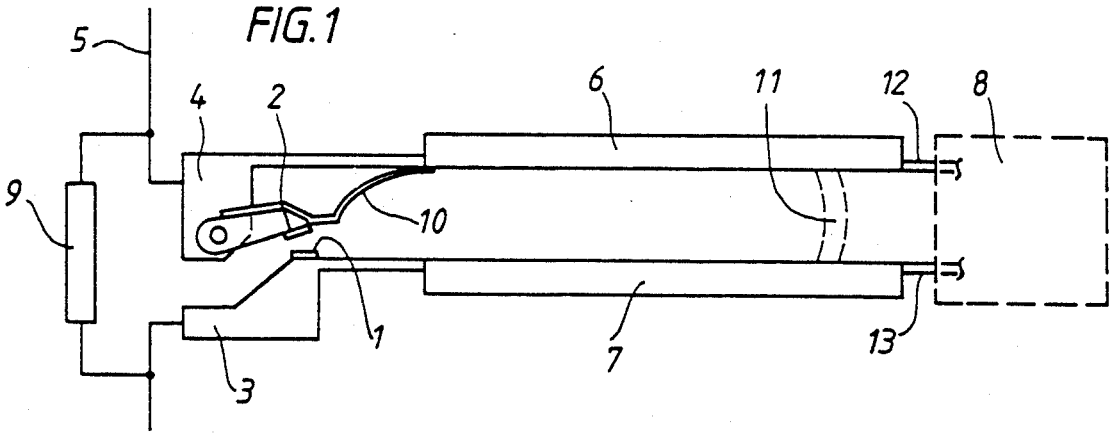
FIG. 1 shows the principle of a current limiter with a commutating unit according to the invention.

The current limiter schematically shown in FIG. 1 comprises a contact device of, for example, the kind described in Swedish patent application 8701230-8. The contact device comprises a fixed contact 1 and a movable contact 2. The contacts 1 and 2 are each connected to a respective connection member 3 and 4 for connection of the current limiter into a phase conductor 5 in a medium voltage network with an operating voltage of, for example, 12 kV.

From the contact device 1, 2 there extend two elongated, parallel runner rails 6 and 7, for example of the kind described in U.S. Pat. No. 4,714,974. At that end of the rails 6, 7 which is near the contact device 1, 2, the rails 6, 7 are each connected to a respective one of the connection members 3 and 4. At the other end of the rails 6, 7, a commutating unit 8 is arranged, the duty of which is to commutate the arcing current over to a resistor 9 connected in parallel with the contact device 1, 2. The current limiter is provided with a tripping device (not shown) actuated by the current through the phase conductor 5.

The contact device 1, 2 is normally closed. If the current in the phase conductor 5 exceeds a certain limit, the tripping device is actuacted and the contact device opens very fast. The arc 11 which is thus produced will be driven away from the contact unit, by the influence of the magnetic field generated by the current, and be moved via a movable commutating conductor 10 along the runner rails 6, 7 and into the commutating unit 8. The runner rails 6, 7, whose total resistance may be, for example, 0.8Ω, are thus connected into the circuit in a time of less than 3 ms from the instant when the short circuit occurred. In this way, a considerable limitation of even the first current peak is attained. In the commutating unit 8 the arc continues to burn until the current passes through zero. Upon the passage through zero, the arc is extinguished and the current is commutated to the parallel resistor 9. The resistance value for this resistor is chosen with regard to the local conditions and may, for example, lie between 2 and 8Ω. The parallel resistor 9 thus provides a further limitation of the short-circuit current during the subsequent half-cycles until the ordinary circuit breaker in the line disconnects the fault current. Instead of connecting the parallel resistor 9 in front of the runner rails 6, 7, as shown in FIG. 1, the resistor can be connected at the end of the rails 6, 7 in immediate proximity to the commutating unit 8.

Figure 2:
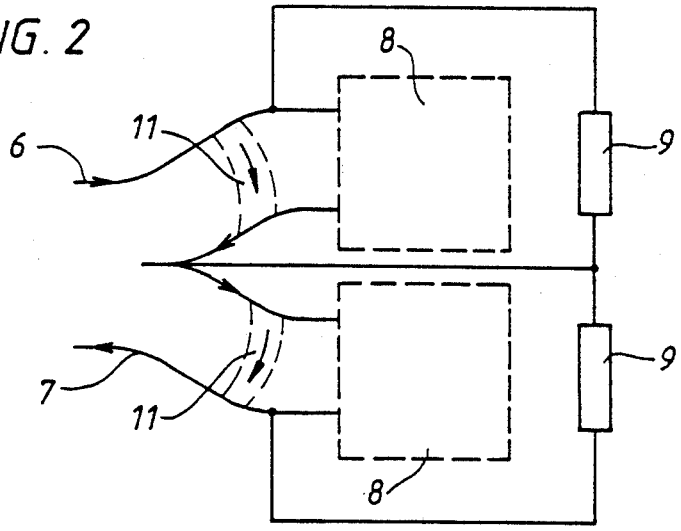
FIG. 2 shows an alternative embodiment with two series-connected commutating units.

To cope with the recovery voltage in networks with higher operating voltages, a number of commutating units 8 can be connected in series, as shown in FIG. 2.

Each unit is then connected in parallel with an external resistor 9.

Figure 3:
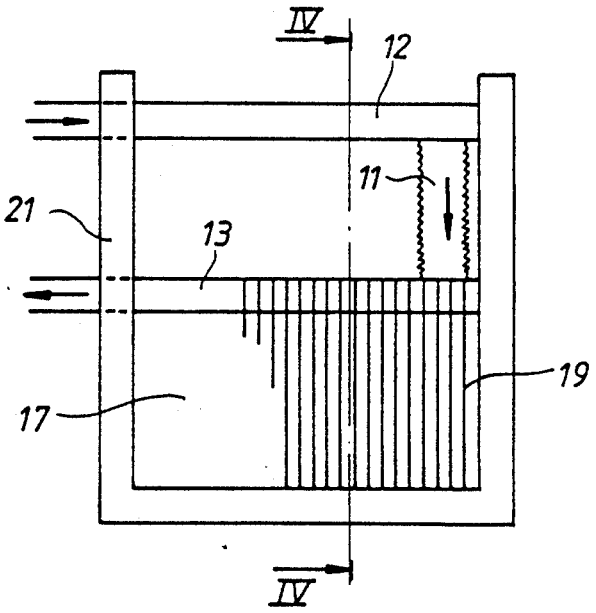
FIGS. 3 and 4 show schematically how the commutating unit operates, FIG. 3 being a longitudinal section through the unit and FIG. 4 a cross section along the line IV–IV in FIGS. 3, and FIGS. 5 and 6 show an embodiment in practice of such a commutating unit, partly in longitudinal section (FIG. 5), partly in cross section (FIG. 6) along the line VI–VI in FIG. 5.
Figure 4:
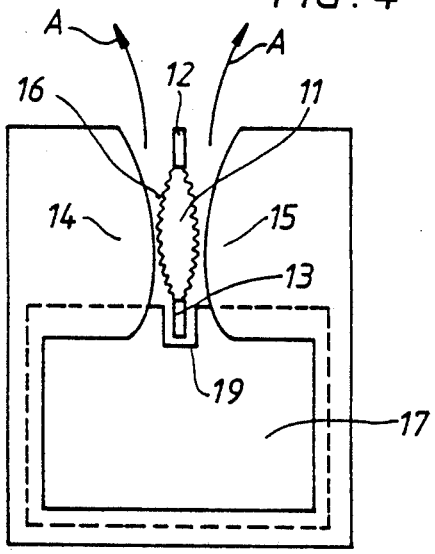

FIGS. 3 and 4 show the principle of operation for a preferred embodiment of the commutating unit. The arc 11 travels in between two rails 12, 13 and two nozzle halves 14, 15 of insulating material, which form a gap 16 between them. The inlet of the nozzle is connected to a closed volume 17, in the following called the pressure accumulating chamber. The lower rail 13 runs along the nozzle inlet and the upper rail 12 along the nozzle outlet. The arc stops towards the end of the rails and burns there until the passage through zero of the current occurs and the current commutation to the parallel resistor is performed. In the meantime, an overpressure builds up in the pressure accumulating chamber 17. After the current zero passage, the hot arc residues are effectively cleaned away with the aid of the overpressure in the pressure accumulating chamber 17, which provides a gas flow in the direction of the arrows A. To cool the gas in the pressure accumulating chamber 17 and direct the pressure gas flow to the spot where the arc is burning, the chamber 17 is divided into small sub-volumes 18 defined by metal plates 19.

Figure 6:
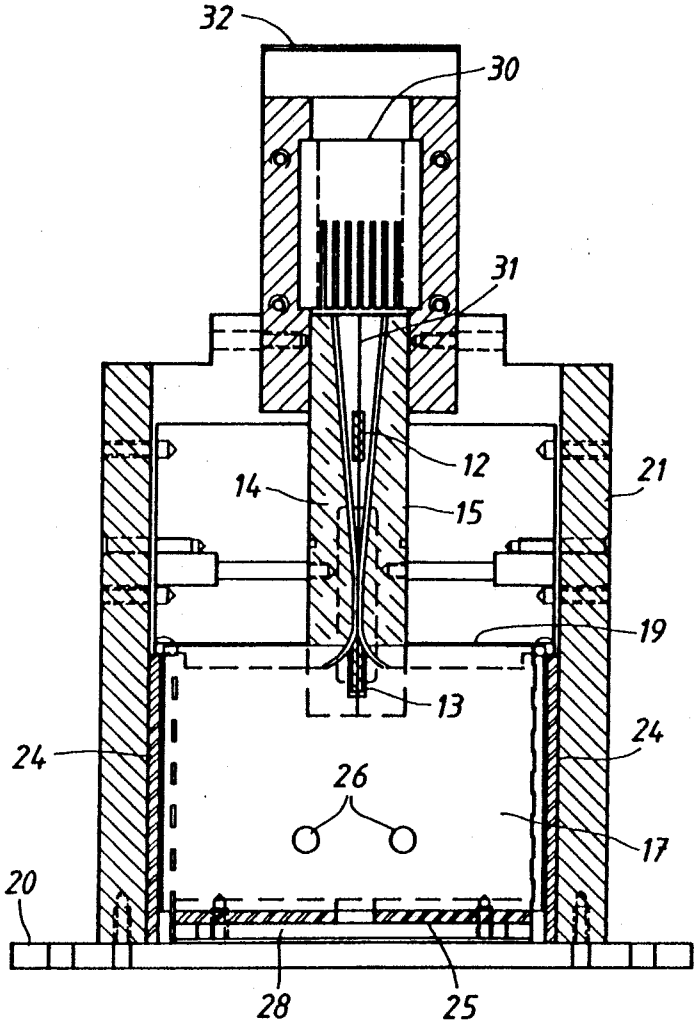
Figure 5:
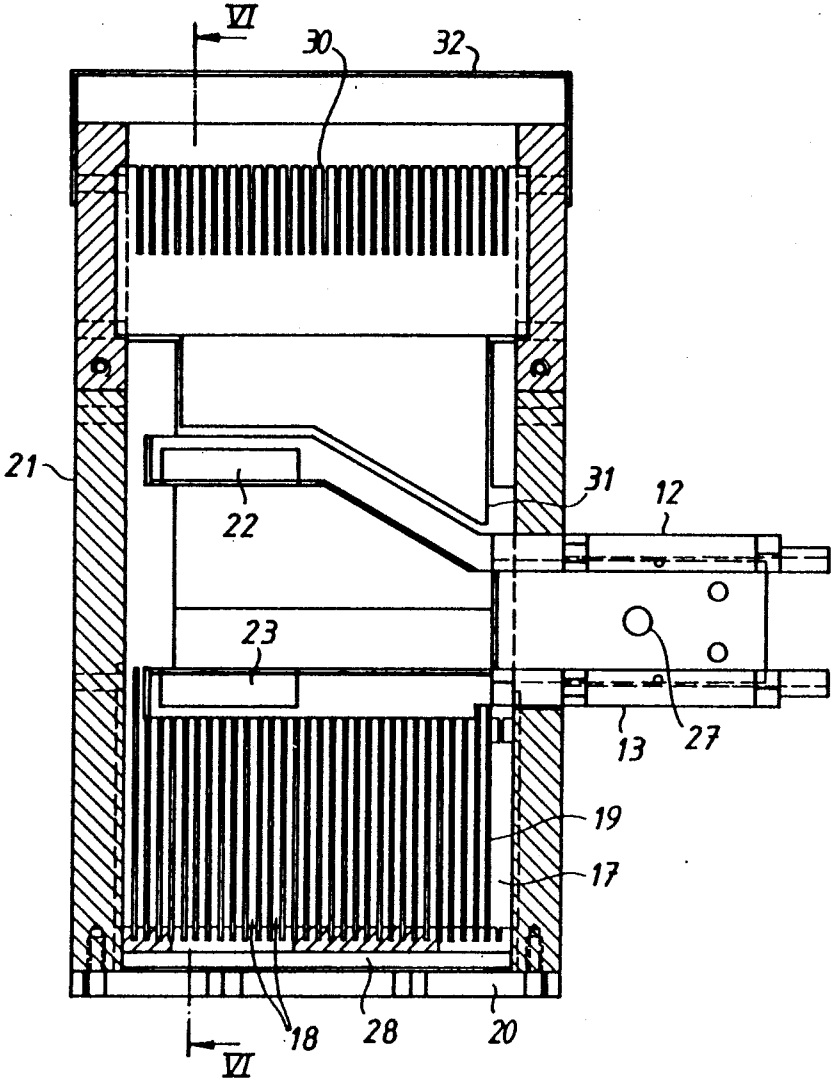

The embodiment of the commutating unit shown in FIGS. 5 and 6 has a housing 21 of insulating material mounted on a mounting plate 20, the nozzle halves 14, 15 being fixed in the housing 21. The nozzle halves form between them a gap, the width of which decreases from, for example, 4 mm where the rails 12, 13 enter the commutating until to near zero at the ends of the rails. The nozzle halves are made of a material which gives off gas when brought into contact with the arc, for example acetal plastic. This brings about a more powerful pressure increase in the pressure accumulating chamber 17 and, in addition, an effective direct injection into the arc columns of relatively cold gas from the wall material, which accelerates the deionization of the residual gases from the arc.

The distance between the rails 12, 13 increases in a direction towards the ends of the rails situated in the commutating unit, which ends are provided with ferrules 22, 23 of an arc-resistant material, for example copper tungsten.

Two retainer plates 24 and one bottom plate 25 are arranged in the pressure accumulating chamber 17 for fixing the metal plates 19 and for sealing between them. A number of those metal plates which are positioned nearest the free end portions of the rails 12, 13 are provided with holes 26 for gas communication between the sub-volumes 18 defined by the metal plates. This results in a more efficient blow-off of the residual gases from the arc. The hole area in the plates may possibly increase successively in a direction towards that metal plate which is located at the front end of the direction of travel of the arc.

Near the outlet of the nozzle the commutating unit is provided with a cooling grid 30 consisting of crossed plates, which between them form channels for cooling the gases flowing out. Between the upper rail 12 and the cooling grid 30, the nozzle outlet is divided by a longitudinal mid-plate 31, the duty of which is to reduce the tendency to turbulence so as to obtain a faster outflow. Over the cooling grid, spaced therefrom, there is a cover plate 32 which reduces the velocity of the outflowing gas and directs the gas flow to the side. In this way, the switchgear space required for the current limiter can be reduced.

The metal plates 19 are connected together by a metal foil at the bottom of the sheet package and via a resistor connected to the lower rail 13. In similar manner, the cooling grid 30 is connected, via a resistor, to the upper rail 12. The resistance of the resistors may, for example, be between 100Ω and 1 kΩ. In this way, the arc is prevented from standing on the plates.

To counteract a return flow of hot gas from the commutating unit 8 to the gap between the runner rails 6, 7, a pressure gas connection can be arranged, for example through a tube or hose, from the lower part of the pressure accumulating chamber 17 to a connection opening 27 leading into the gap between the rails 12 and 13 at the point where these enter the commutating unit. The connection to the pressure accumulating chamber can suitably take place via a space 28 arranged between the bottom plate 25 and the mounting plate 20. The connection opening is directed obliquely inwards in such a way that the pressure gas flow passes in a direction towards the arc column at the free ends of the rails.

The invention is not limited to the embodiment shown but can be materialized in many different ways within the scope of the claims. For example, the runner rails 6, 7 need not consist of elongated resistive runner rails as described above. Instead, the commutating unit can be arranged in immediate association with the contact device, and the runner rails can then consist of relatively short arc horns. Further, the nozzle 14, 15 need not necessarily be gap-formed but may instead be formed rotary-symmetrical.

We claim:

1. A current limiter, comprising:

a contact device with at least two cooperating contacts, at least one of which is movable between a closed and an open position;

at least two runner rails associated with the contact device, said runner rails being so arranged that the arc which is produced upon contact opening when a short-circuit current flows in the circuit, under the influence of the magnetic field generated by the current, is moved away from the contact device with the foot points of the arc running along the rails;

a commutating circuit for commutation of the arcing current to a parallel resistor, said commutating unit surrounding those ends of the rails which are situated furthest away from the contact device; a gap for enclosing the arc arranged in the commutating unit, between said two rails, said gap being defined by means of walls of a gas-insulating material, said gap being formed as a nozzle;

one of the runner rails extending along the nozzle inlet and the other runner rail extending along the nozzle outlet; and a pressure-accumulating chamber being arranged near the nozzle inlet for venting hot arc residues and said pressure-accumulating chamber being divided into a number of sub-volumes defined by metal plates for cooling and guiding the gas flow.

2. A current limiter according to claim 1, wherein the metal plates are mutually parallel and arranged substantially perpendicularly to the longitudinal direction of the runner rails.

3. A current limiter according to claim 2, wherein those metal plates which are situated nearest the ends of the runner rails have holes for gas communication between adjacently located sub-volumes.

4. A current limiter according to claim 1, wherein the metal plates are electrically connected to each other and to the rail (13) positioned at the nozzle inlet.

5. A current limiter, comprising:

a contact device with at least two cooperating contacts, at least one of which is movable between a closed and an open position;

at least two runner rails associated with the contact device, said runner rails being so arranged that the arc which is produced upon contact opening when a short-circuit current flows in the circuit, under the influence of the magnetic field generated by the current, is moved away from the contact device with the foot pionts of the arc running along the rails;

a commutating circuit for commutation of the arcing current to a parallel resistor, said commutating unit surrounding those ends of the rails which are situated furthest away from the contact device; a gap for enclosing the arc arranged in the commutating unit, between said two rails, said gap being defined by means of walls of a gas-insulating material, said gap being formed as a nozzle;

one of the runner rails extending along the nozzle inlet and the other runner rail extending along the nozzle outlet;

a pressure-accumulating chamber being arranged near the nozzle inlet for venting hot arc residues and said pressure-accumulating chamber being divided into a number of sub-volumes defined by metal plates for cooling and guiding the gas flow; and a pressure gas connection extending from the pressure-accumulating chamber to the gap between the runner rails at the entrance to the commutating unit so that return flow of hot gases from the arc to said gap is counteracted.

6. A current limiter, comprising:

a contact device with at least two cooperating contacts, at least one of which is movable between a closed and an open position;

at least two runner rails associated with contact device, said runner rails being so arranged that the arc which is produced upon contact opening when a short-circuit current flows in the circuit, under the influence of the magnetic field generated by the current, is moved away from the contact device with the foot points of the arc running along the rails;

a commutating cicuit for commutation of the arcing current to a parallel resistor, said commutating unit surrounding those ends of the rails which are situated furthest away from the contact device; a gap for enclosing the arc arranged in the commutating unit, between said two rails, said gap being defined by means of walls of a gas-insulating material, said gap being formed as a nozzle;

said commutating unit further including a cooling grid arranged outside the nozzle outlet with channels for cooling the outflowing gases, said cooling grid being connected via a resister to the rail positioned along the nozzle outlet;

one of the runner rails extending along the nozzle inlet and the other runner rail extending along the nozzle outlet; and a pressure-accumlating chamber being arranged near the nozzle inlet for venting hot arc residues and said pressure-accumulating chamber being divided into a number of sub-volumes defined by metal plates for cooling and guiding the gas flow.

* * * * *